33-233 SR
8/4/87 OR 4,683,662

United States Patent [19]

Kiss, Jr.

[11] Patent Number: 4,683,662

[45] Date of Patent: Aug. 4, 1987

[54] RAPID PISTOL SIGHTING ATTACHMENTS

[76] Inventor: Zolton C. Kiss, Jr., 1257 Calle Castano, Thousand Oaks, Calif. 91360

[21] Appl. No.: 900,639

[22] Filed: Aug. 27, 1986

[51] Int. Cl.[4] ..... F41G 1/00; F41G 1/10

[52] U.S. Cl. ..... 33/233; 33/243

[58] Field of Search ..... 33/233, 242, 243

[56] References Cited

U.S. PATENT DOCUMENTS

| | | | |
|---|---|---|---|
| 496,051 | 4/1893 | Freund | 33/233 |
| 872,360 | 12/1907 | Marble | 33/233 |
| 1,206,310 | 11/1916 | Debuchy | 33/233 |
| 2,874,504 | 2/1959 | Martinek | 33/233 |
| 3,091,863 | 6/1963 | Munsy | 33/233 |
| 4,008,536 | 2/1977 | Adams | 33/233 |

FOREIGN PATENT DOCUMENTS

| | | | |
|---|---|---|---|
| 42745 | 9/1908 | Switzerland | 33/233 |

*Primary Examiner*—Richard R. Stearns
*Attorney, Agent, or Firm*—Poms, Smith, Lande & Rose

[57] ABSTRACT

A rapid and adjustable sighting system for pistols includes front and rear spring clips, which may be easily and removably attached to the existing front and rear sights of virtually all conventional pistols. The front sight attachment includes a generally U-shaped spring metal clip, which may be secured to the front sight of a pistol by glue, soldering or pinning, for example. Pins with various sized and colored heads may be selectively mounted on the spring clip to provide the front sight. A second spring clip, also of U-shaped cross-sectional configuration, is similarly attached to the rear sight of a conventional pistol, and includes a central recess for receiving spring plastic rear sight inserts. The plastic rear sight inserts are generally circular, have an upper sector of about 60 degrees to 140 degrees removed from the top of the plastic insert sights, to provide an unobstructed view of the front sight and the target. Both the front and rear sights are readily interchangeable, with sights of different diameters and colors to provide optimum visual sighting under a variety of conditions.

20 Claims, 9 Drawing Figures

22
26
24
28
20
18

30
32
46
40
42
44
34
36
38

14
16

.500"
MEDIUM I.D. .110"
62
66

.600"
SMALL I.D. .100"
56
34

SMALL DIA. .050"
LARGE I.D. .120"
28
42
34
16

LARGE DIA. .060"
18
14
52

.060"DIA.
26
28

RAPID PISTOL SIGHTING ATTACHMENTS

FIELD OF THE INVENTION

The present invention relates to a combined front and rear sight system for pistols.

BACKGROUND OF THE INVENTION

The conventional or "partridge" sight for pistols includes a rectangular front sight and a transverse rear sight with a rectangular notch, with which the front sight is aligned as the pistol is aimed. Particularly for distant targets, the front sight may cover a substantial portion, such as half, of the target. Many variations on the basic "partridge" sight design have been proposed heretofore with sun shades being used for the front sight, and various interchangeable rear sights having been proposed. However, virtually all of the sights which have been proposed heretofore have significant shortcomings, either being limited in their application to various target environments, or severely restricting the user's view of the target.

Accordingly, the principal object of the present invention is to provide a flexible pistol sight system which may easily be adjusted to accommodate virtually all pistol firing target conditions.

SUMMARY OF THE INVENTION

In accordance with one specific illustrative embodiment of the invention, a rapid sighting adjustable front and rear pistol sight system includes:

1. A front sight attachment including a generally U-shaped spring metal clip, mounting arrangements for securing the clip to the front sight of a conventional pistol and a series of interchangeable sighting pins having varying diameters and colors, and interfitting arrangements for mounting a selected one of the pins on the upper portion of the clip, with the pin being aligned with the bore of the pistol; and
2. A rear sighting attachment including a spring metal clip housing and arrangements for securing the clip housing to the rear blade sight of a conventional pistol; and a series of springy plastic sight inserts, each forming a generally circular sight with a sector of about 60 degrees to 140 degrees removed from the top of each sight insert, and arrangements for removably mounting a selected one of these sight inserts into the spring metal clip housing with the center of the circular rear sight insert and the front sight pin being aligned parallel to the sighting and firing line of the pistol.

From another aspect the present invention involves a combination of any of the following pistol sight features:

1. The use of removable U-shaped metal spring clips for both the front and the rear sight support of a sighting system.
2. The use of removable front pins, and corresponding rear plastic sight elements of circular configuration and with an opening at the top thereof, with the pins for the front sight and the circular rear sights being available in different sizes and colors to accommodate different environmental and optical sighting conditions.
3. The use of both underlying spring slips which are removably attachable to the sights of a conventional pistol and a variety of different sized and different colored sights which may be selectively attached to both of the two spring clips.
4. The use of a rear sight assembly including the U-shaped spring clip housing having a central upper recess, to be secured to the rear sight of the pistol, and a springy plastic insert having a central circular sighting zone and two flexible outwardly extending legs which may be snapped into place within the spring clip housing.
5. The inverted U-shaped front metal spring clip is aligned with the pistol and is formed of thin springy metal in the order of less than 0.020 inch thick so that there is substantially no blocking of the target by the support; and the pin head and support arrangements forming the front sight permits a substantially 360 degree peripheral view of the target around the front sight pin.

Advantages of the sighting system include the following:

1. The spring nature of the front and rear sight support clips allow the front and rear clips to adjust to dimensional variables found in different standard piston sights.
2. The front sight, being U-shaped, when clipped to the front sight of a standard hand gun, allows for space between the top of the original pistol front sight and the pin forming the principal front aiming point for the front sight. When aiming the pistol, the space below the pin allows the user to see 360 degrees around the target, as mentioned above.
3. The aim point on the new front sight is a removable pin with a drop of colored paint or plastic at one end, with the pins having drops of paint or plastic being available in different colors and diameters to accommodate different sighting environments.
4. Similarly, the replaceable springy plastic rear sight inserts offer the shooter a variety of rear sight colors and inner diameters.
5. The new spring clips may be readily attached and removed from conventional hand guns so that users may revert to the original pistol style if, for any reason, they decide not to use the new sighting system.
6. The new sight system has a low profile, is light weight, and does not impair the carrying or handling of the pistol.
7. The sight system of the present invention trains the shooter's eye to concentrate on the exact center of the front sight—resulting in a more precise sight picture and improved marksmanship.
8. The wide variety of front and rear sight inserts can be clipped into position very quickly without changing the main sight adjustment or aim point.

Incidentally, as a matter of interest, when the front and rear sight inserts are available in red and white colors, the red is normally employed under bright lighting conditions, while white is used under low light conditions. A small front pin is employed for precise or accurate shooting, while a large diameter front pin is employed for fast shooting or for accommodating for a shooter's relatively low visual acuity. A small inner diameter rear insert may be employed for hunting and "plinking"; and a large inner diameter rear insert may be used for fast and close shooting.

Other features and advantages of the invention will become apparent from a consideration of the following detailed description and the accompanying drawings.

DETAILED DESCRIPTION

Figures 1, 2A, 2B, 3, 4, 5, 6, 7, 8:
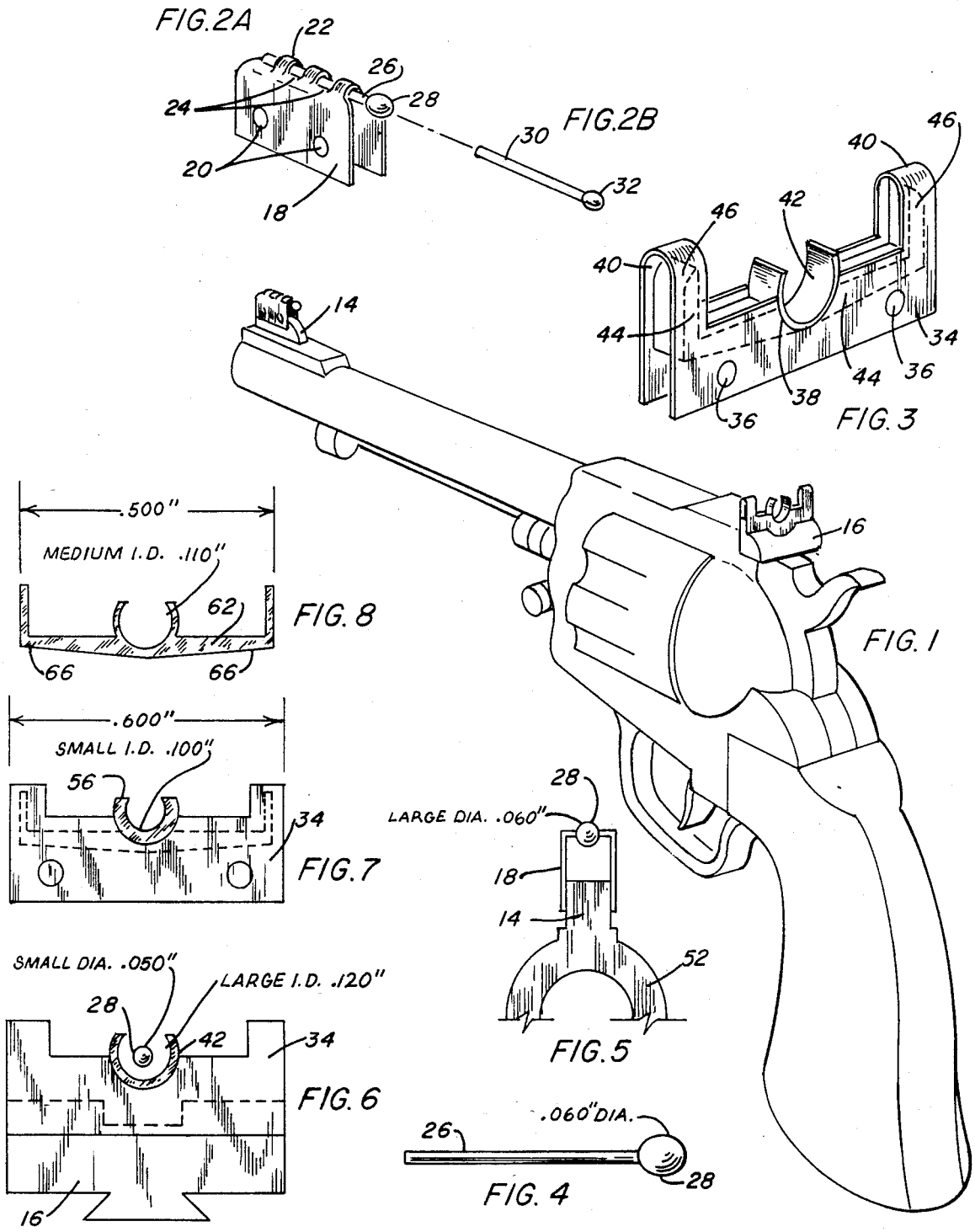
FIG. 1 is a perspective view of a pistol showing front and rear sights illustrating the principles of the present invention.
FIG. 2A is an enlarged view of the spring clip and one alternative front sight pin, as shown in FIG. 1.
FIG. 2B shows one of the removable front sight pins disassembled from the spring clip forming the front sight support.
FIG. 3 shows the rear spring clip housing and spring plastic insert in enlarged form, as compared with the showing of FIG. 1.
FIG. 4 is an enlarged showing of the pin of FIG. 2B.
FIG. 5 is a view showing the upper portion of the front of a pistol barrel with the spring metal sight support and the head of the pin mounted on a conventional pistol sight.
FIG. 6 is a schematic showing of a rear sight, the rear sight spring clip illustrating principles of the invention, and the plastic front and rear sight inserts.
FIG. 7 shows a springy plastic rear sight insert mounted in the rear sight metal housing.
FIG. 8 shows an alternative rear sight plastic insert, illustrating one aspect of the present invention.

Referring more particularly to the drawings, FIG. 1 shows a conventional pistol 12 having a conventional front sight 14 and rear sight 16. Secured to the front sight 14 is the U-shaped spring clip 18. The clip 18 has two openings 20 on each side thereof to facilitate attachment to the front sight of the pistol by a suitable glue such as cyanocrylate, for example. The upper surface of the spring clip 18 is provided with three upwardly extending loops 22 which, together with the underlying spring steel portion 24, form a circular opening into which the sighting pin 26 may be inserted. The sighting pin 26 is provided with a bead 28 which may be of any desired color, with white and red being preferred colors. An alternate pin having a shaft 30 and a head 32 is shown in FIG. 2B and has a somewhat smaller head of a different color than the sighting pin 26, 28.

Now, referring to the rear sight, FIG. 3 is an enlarged view of the spring metal housing 34 having two openings 36 on each side thereof for securing to the conventional rear sight 16 at the rear of pistol 12. The spring metal clip 34 has a central recess 38 and two upstanding inverted U-shaped arms 40. The plastic insert, as shown in FIG. 3, has a central circular sighting portion 42 and two outwardly extending springy arms 44. The upper tips 46 of these springy arms bear on the inverted U-shaped portions 40 of the spring clip 34 and push the central portion 42 of the plastic sighting member down into the recess 38 in the rear spring housing 34. The plastic insert 42 may be easily removed by applying pressure to the side of the central portion 42 upward and at an angle of approximately 45 degrees relative to the horizontal.

An mentioned above, FIG. 4 is an enlarged showing of one of the pins, such as pin 26 having the head 28.

FIG. 5 is a schematic showing of the front barrel 52 of the pistol having an original sight 14 to which the spring clip 18 has been secured. The pin having a bead 28 is shown mounted in the clip 18. FIG. 5 clearly shows how the front sight permits a virtually unobstructed view around the sighting bead or pin head 28.

FIG. 6 shows a conventional rear sight 16 to which the rear spring metal housing 34 has been secured, and in which the springy plastic insert 42 has been mounted. The front sighting pin 28 is also shown in FIG. 6 to indicate the clear nature of the sighting capabilities of the present system. In FIG. 6 a small front sight diameter of approximately 0.050 inch diameter is used, with a relatively large inner diameter rear sight, having an inner diameter of about 0.120 inch.

FIG. 7 shows an alternative rear plastic insert configuration in which the plastic insert 56 has a reduced inner diameter of approximately 0.100 inch.

FIG. 8 shows one of the alternative springy plastic rearsight members 62 with the central sighting area 64 and the two outer springy arms 66. As indicated by the dimensions associated with FIG. 8, the overall extent of the member 62 may be approximately ½ inch, and the medium inner diameter is 0.110 inch.

In the introduction of the present specification the nature of the prior types of available sights have been briefly mentioned. For completeness, the following U.S. patents showing various forms of prior art sights are identified:

U.S. Pat. Nos. 986,376—W. O. French, 2,479,277—A. L. Terhaar, 2,932,896—J. J. Hicinbothem, 3,911,607—George C. Leubkeman, 4,505,047—Ronald E. Elbe, 827,360—Webster L. Marble, 1,268,537—Gustav A. Bader, 496,051—F. W. Freund, 2,615,252—Dee A. Wing, 3,030,706—R. I. Daniel, 846,217—D. W. King, Jr., 2,439,086—William W. Hanley.

The sights disclosed in the foregoing patents generally are not integrated front and rear pistol sights, have the shortcomings mentioned in the introduction of this application, and none of them have the construction or the advantages disclosed and claimed herein.

It is to be understood that the foregoing description and the accompanying drawings relate to one illustrative embodiment of the invention. Variations of this basic design may, of course, be accomplished. Thus, by way of example and not of limitation, the front pin, and the rear springy inserts may be secured to associated spring metal clips by alternative mechanical arrangements. Accordingly, the present invention is not limited precisely to the configuration as shown in the drawings and as described hereinabove.

What is claimed is:

1. A rapid sighting adjustable front and rear pistol sighting system comprising:

a front sight attachment including a generally U-shaped spring metal clip, means for securing said clip to the front sight of a pistol, a plurality of interchangeable sighting pins, and means for mounting a selected one of said pins on the upper portion of said clip aligned with the bore of the pistol; and a rear sight attachment including a spring metal clip housing, and means for securing said clip housing to the rear blade sight of the pistol; and a plurality springy rear sight inserts, each forming a generally circular sight with a sector of about 60 degrees to 140 degrees removed from the top thereof, and means for removably mounting a selected one of said sight inserts into said spring metal clip housing, with the center of the circular rear sight insert and said front sight pin being aligned parallel to the sighting and firing line of said pistol.

2. A rapid sighting adjustable front and rear pistol sighting system, as defined in claim 1 wherein said spring metal housing is U-shaped, and has a central recess; and wherein said springy rear sight inserts have means including a central body for interfitting with said recess, and outwardly extending arm means for engaging said spring metal housing and forcing said central body down into said recess.

3. A rapid sighting adjustable front and rear pistol sighting system, as defined in claim 1, wherein said U-shaped spring metal clip includes means for securing it to the front sight in alignment with the barrel of the pistol, to permit easy viewing of a target around the sighting pins.

4. A rapid sighting adjustable front and rear pistol sighting system, as defined in claim 1, wherein said sighting pins include pins having different head diameters and different colors.

5. A rapid sighting adjustable front and rear pistol sighting system, as defined in claim 1 wherein said sighting pins include pins having different colors.

6. A rapid sighting adjustable front and rear pistol sighting system, as defined in claim 1 wherein said springy rear sight inserts include inserts of different colors.

7. A rapid sighting adjustable front and rear pistol sighting system, as defined in claim 1 wherein said springy rear sight inserts include inserts wherein the inner diameters of the generally circular sight are different.

8. A rapid sighting adjustable front and rear pistol sighting system comprising:

a front sight attachment including a generally U-shaped spring metal clip, means for securing said clip to the front sight of a pistol, a plurality of interchangeable sighting pins, and means for mounting a selected one of said pins on the upper portion of said clip aligned with the bore of the pistol; and a rear sight attachment including a spring metal clip housing, and means of securing said clip housing to the rear blade sight of the pistol; and a plurality of springy rear sight inserts, each forming a generally circular sight, with a sector of about 60 degrees to 140 degrees removed from the top thereof, and means for removably mounting a selected one of said sight inserts into said spring metal clip housing, with the center of the circular rear sight insert and said front sight pin being aligned parallel to the sighting and firing line of said pistol;

said spring metal housing being U-shaped having a central recess, and said springy rear sight inserts having means including a central body for interfitting with said recess, and outwardly extending arm means for engaging said springy metal housing and forcing said central body down into said recess.

9. A rapid sighting adjustable front and rear pistol sighting system, as described in claim 8, wherein said U-shaped spring metal clip includes means for securing it to the front sight in alignment with the barrel of the pistol, to permit easy viewing of a target around the sighting pins.

10. A rapid sighting adjustable front and rear pistol sighting system, as decribed in claim 8, wherein said sighting pins include pins having different head diameters and different colors.

11. A rapid sighting adjustable front and rear pistol sighting system, as described in claim 8, wherein said sighting pins include pins having different colors.

12. A rapid sighting adjustable front and rear pistol sighting system, as described in claim 8, wherein said springy rear sight inserts include inserts of different colors.

13. A rapid sighting adjustable front and rear pistol sighting system, as described in claim 8, wherein said springy rear sight inserts include inserts wherein the inner diameters of the generally circular sight are different.

14. A rapid sighting adjustable front and rear pistol sighting system comprising:

a front sight attachment including a generally U-shaped spring metal clip, means for securing said clip to the front sight of a pistol, a sighting pin, and means for mounting said pin on the upper portion of said clip aligned with the bore of the pistol; and a rear sight attachment including a rear sight support; means for securing said rear sight support to the rear blade sight of the pistol;

a sight insert forming a generally circular sight with a sector of about 60 degrees to 140 degrees removed from the top thereof, and means for removably mounting a said sight insert onto said rear sight support, with the center of the circular rear sight insert and said front sight pin being aligned parallel to the sighting and firing line of said pistol.

15. A rapid sighting adjustable pistol sighting system, as defined in claim 14, wherein said rear sight support is a springy metal housing of U-shaped configuration, having a central recess; and wherein said sight insert is a springy plastic insert having means including a central body for interfitting with said recess and outwardly extending arm means for engaging said springy metal housing and forcing said central body down into said recess.

16. A rapid sighting adjustable front and rear pistol sighting system, as described in claim 14, wherein said U-shaped spring metal clip includes means for securing it to the front sight in alignment with the barrel of the pistol, to permit easy viewing of a target around the sighting pin.

17. A rapid sighting adjustable front and rear pistol sighting system, as defined in claim 14, including a plurality of sighting pins, and wherein said sighting pins include pins having different head diameters and different colors.

18. A rapid sighting adjustable front and rear pistol sighting system, as defined in claim 14, including a plurality of sighting pins and wherein said sighting pins include pins having different colors.

19. A rapid sighting adjustable front and rear pistol sighting system, as defined in claim 14, including a plurality of rear sight inserts and wherein said rear sight inserts include inserts of different colors.

20. A rapid sighting adjustable front and rear pistol sighting system, as defined in claim 14, including a plurality of rear sight inserts and wherein said rear sight inserts include inserts wherein the inner diameters of the generally circular sight are different.

* * * * *